United States Patent [19]

Black et al.

[11] Patent Number: 4,776,125

[45] Date of Patent: Oct. 11, 1988

[54] PORTABLE RAM ROD

[76] Inventors: Vernon A. Black, 95 E. 200 N., Kanab, Utah 84741; George Spector, 233 Broadway RM 3815, New York, N.Y. 10007

[21] Appl. No.: 75,424

[22] Filed: Jul. 20, 1987

[51] Int. Cl.[4] ..... B65H 17/44; F41C 31/00

[52] U.S. Cl. ..... 42/95; 15/104.165; 242/96

[58] Field of Search ..... 42/95, 88, 89; 242/96, 242/106; 15/104.2, 104.165, 114

[56] References Cited

U.S. PATENT DOCUMENTS

| | | | |
|---|---|---|---|
| 877,778 | 1/1908 | Kauffman | 15/104.16 |
| 1,556,494 | 10/1925 | Cooper | 42/95 X |
| 1,915,238 | 6/1933 | Mosher et al. | 242/96 |
| 2,544,847 | 3/1951 | Malesky | 42/95 |
| 2,592,415 | 4/1952 | Grogan | 42/89 |
| 3,044,732 | 7/1962 | Simonds | 242/96 |
| 3,357,654 | 12/1967 | Losman et al. | 242/96 |
| 4,195,794 | 4/1980 | Ricci et al. | 242/96 X |
| 4,222,142 | 9/1980 | Prospero | 15/114 X |
| 4,399,627 | 8/1983 | Malesky et al. | 42/95 |
| 4,531,686 | 7/1985 | Shaw | 242/96 |

FOREIGN PATENT DOCUMENTS

| | | | |
|---|---|---|---|
| 474799 | 11/1937 | United Kingdom | 15/104.165 |

*Primary Examiner*—David H. Brown

[57] ABSTRACT

A gun barrel cleaner is provided and consists of a flexible cable with patch holder on free end. The cable is wound upon a spool which can be worn on a belt of a person. A removable brush member can also be provided to aid in cleaning the gun barrel.

1 Claim, 1 Drawing Sheet

PORTABLE RAM ROD

BACKGROUND OF THE INVENTION

The instant invention relates generally to cleaning implements and more specifically it relates to a gun barrel cleaner.

Numerous cleaning implements have been provided in prior art that are adapted to clean gun barrels and remove obstructions therefrom. For example U.S. Pat. Nos. 2,897,525; 3,708,820 and 4,399,627 all are illustrative of such prior art. While these units may be suitable for the particular purpose to which they address, they would not be as suitable for the purposes of the present invention as heretofore described.

SUMMARY OF THE INVENTION

A primary object of the present invention is to provide a gun barrel cleaner that will overcome the shortcomings of the prior art devices.

Another object is to provide a gun barrel cleaner that includes a flexible cable with patch holder wound upon a spool which can be worn on a belt of a person.

An additional object is to provide a gun barrel cleaner that includes a removable brush member to aid in cleaning the gun barrel.

A further object is to provide a gun barrel cleaner that is simple and easy to use.

A still further object is to provide gun barrel cleaner that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
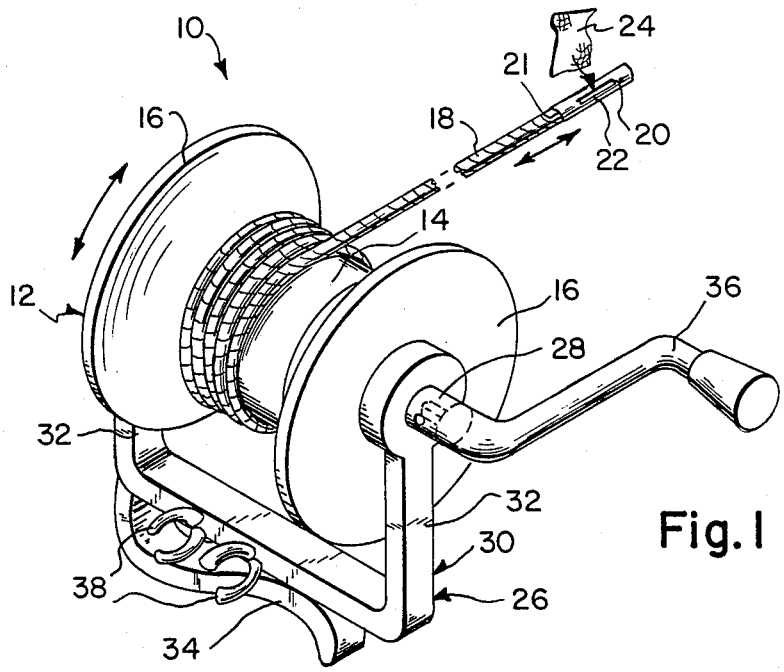
FIG. 1 is a perspective view of the invention.

Turning now descriptively to the drawings, in which similar reference characters denote similar elements throughout the several views, FIG. 1 illustrates a gun barrel cleaner 10 that contains a spool 12 that has a barrel portion 14 and a pair of flange ends 16. An elongated flexible cable meber 18 is laterally bendable for coiling around the barrel portion 14 on the spool 12. A patch holder 20 that has a slot 22 is affixed to free end 21 of the elongated flexible cable member 18. The slot 22 is for engaging a cleaning patch 24 to clean barrel of a gun (not shown).

A structure 26 is provided for securing the spool 12 to a belt of a person (not shown). The structure 26 includes a shaft 28 to extend through the barrel portion 14 of the spool 12. A U-shaped frame meber 30 is provided and has a pair of arms 32 so that the shaft 28 can engage thereto. A clip member 34 is formed on the U-shaped frame member 30 to attach to the belt. A removable crank handle 36 is affixed to one end of the shaft 28 so that the shaft can rotate on the U-shaped frame member 30. A pair of spaced apart C-clamps 38 are formed on the U-shaped frame member 30 to attach to the gun.

Figure 2:
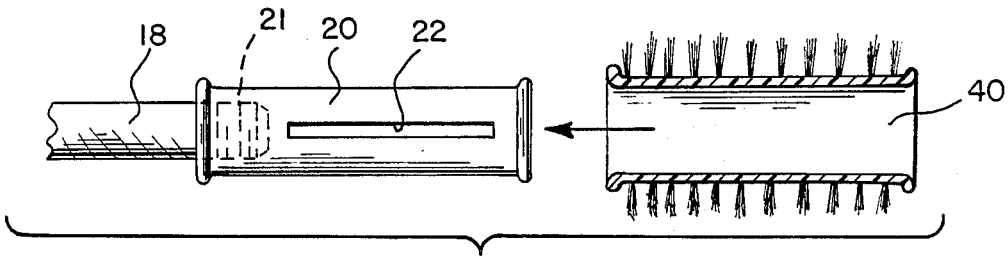
FIG. 2 is a enlarged detail view with parts in section of modified patch holder showing a removable bristle sleeve.

FIG. 2 shows a bristle sleeve 40 that slideably fits onto the patch holder 20 so as to be removable therefrom. The bristle sleeve 40 assists in cleaning the barrel of the gun.

Figure 3:
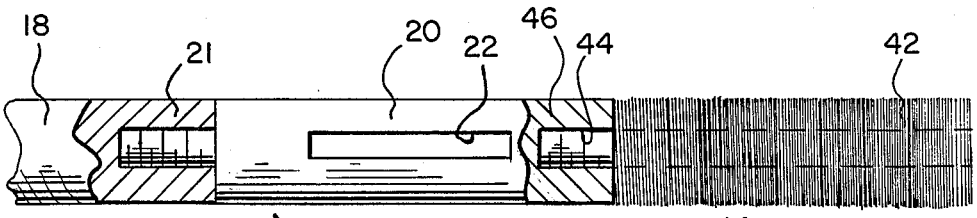
FIG. 3 is an enlarged detail view with parts in section of another modified patch holder showing a removable brush member.

FIG. 3 shows a brush member 42 that has a threaded post 44 that threads into free end 46 of the patch holder 20 so as to be removable therefrom. The brush member 42 assists in cleaning the barrel of the gun.

Figure 4:
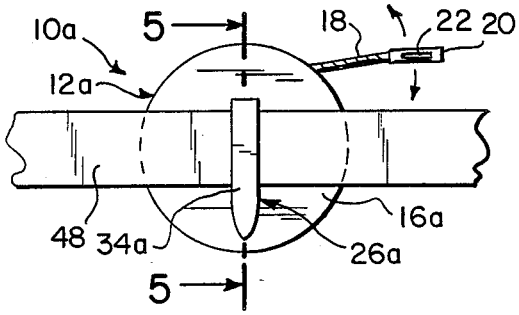
FIG. 4 is a rear view of a modified gun barrel cleaner attached to a belt.
Figure 5:
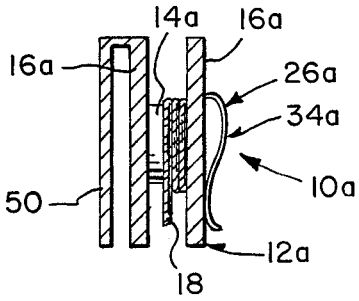
FIG. 5 is a cross sectional view taken along line 5—5 in FIG. 4 showing the clip and patch container in greater detail.

FIGS. 4 and 5 show a modified gun barrel cleaner **10*a* wherein the securing structure 26*a* is a clip member 34*a* formed on one of the flange ends 16*a* of the spool 12*a* to attach to the belt 48. A patch container 50 is formed on other of the flange ends 16*a* of the spool 12*a*** to hold extra cleaning patches.

While certain novel features of this invention have been shown and described and are pointed out in the annexed claim, it will be understood that various omissions, substituions and changes in the forms and details of the device illustrated and in its operation can be made by those skilled in the art without departing from the spirit of the invention.

What is claimed is:

1. A gun barrel cleaner which comprises:

(a) a spool having a barrel portion and a pair of flange ends;

(b) an elongated flexible cable member laterally bendable for coiling around said barrel portion on said spool;

(c) a patch holder having a slot, said patch holder affixed to free end of said elongated flexible cable member, said slot for engaging a cleaning patch to clean barrel of a gun;

(d) means for securing said spool to a belt of a person, wherein said belt securing means is a clip member formed on one of said flange ends of said spool to attach to the belt, further comprising a patch container formed on other of said flange ends of said spool to hold extra cleaning patches.

* * * * *